US011746571B2

(12) United States Patent
Hunt et al.

(10) Patent No.: US 11,746,571 B2
(45) Date of Patent: Sep. 5, 2023

(54) RATCHET UNIT FOR MOTOR VEHICLE FLAPS OR MOTOR VEHICLE DOORS

(71) Applicant: Kiekert AG, Heiligenhaus (DE)

(72) Inventors: Rob Hunt, Davisburg, MI (US); Scott Brown, Livonia, MI (US); Dave Taylor, Livonia, MI (US)

(73) Assignee: Kiekert AG, Heiligenhaus (DE)

( * ) Notice: Subject to any disclaimer, the term of this patent is extended or adjusted under 35 U.S.C. 154(b) by 179 days.

(21) Appl. No.: 17/128,674

(22) Filed: Dec. 21, 2020

(65) Prior Publication Data

US 2022/0195758 A1 Jun. 23, 2022

(51) Int. Cl.

*E05B 81/20* (2014.01)
*E05B 81/06* (2014.01)
*E05B 83/16* (2014.01)

(52) U.S. Cl.

CPC ..... *E05B 81/20* (2013.01); *E05B 81/06* (2013.01); *E05B 83/16* (2013.01); *E05Y 2900/531* (2013.01)

(58) Field of Classification Search

CPC ..... E05B 81/20; E05B 81/06; E05B 81/25; E05B 83/24; E05B 81/10; E05B 81/18; E05B 83/16; E05B 83/243; E05C 1/085; E05C 3/124; E05C 9/002; E05C 19/06; E05C 3/12; E05C 3/16

See application file for complete search history.

(56) References Cited

U.S. PATENT DOCUMENTS 3,924,884 A * 12/1975 Christie ..... E05C 3/16 292/196
4,395,064 A * 7/1983 Bellot ..... E05B 81/20 292/201
5,022,691 A * 6/1991 Clay, Jr. ..... E05C 3/30 292/121
5,174,619 A * 12/1992 Bender ..... E05B 81/04 70/279.1
5,704,663 A * 1/1998 Clay, Jr. ..... E05C 3/124 292/DIG. 32
6,006,560 A * 12/1999 DeVries ..... E05B 13/10 292/38
6,386,599 B1 * 5/2002 Chevalier ..... E05B 77/28 292/201

(Continued)

FOREIGN PATENT DOCUMENTS

DE 202006017864 U1 1/2007
DE 102015014843 A1 5/2017
DE 102017113528 A1 12/2018

*Primary Examiner* — Kristina R Fulton
*Assistant Examiner* — Emily G. Brown
(74) *Attorney, Agent, or Firm* — Renner, Otto, Boisselle & Sklar, LLP

(57) ABSTRACT

A ratchet unit for motor vehicle flaps or motor vehicle doors, in particular motor vehicle rear doors, preferably motor vehicle rear sliding doors, which are equipped with an electromotive drive and a ratchet lever which can be acted on by the drive. The ratchet lever is set up to lock and open the motor vehicle flap. According to the invention, the ratchet lever continuously adopts its closed position and is only moved into its open position with the aid of the drive to open the motor vehicle flap. The ratchet lever in its closed position is deflected resiliently when the motor vehicle flap is closed.

17 Claims, 4 Drawing Sheets

(56) References Cited

U.S. PATENT DOCUMENTS

| | | | | |
|---|---|---|---|---|
| 7,114,753 | B2 * | 10/2006 | Nodorft | E05B 65/0021 292/145 |
| 8,245,549 | B2 * | 8/2012 | Zagoroff | E05B 83/12 292/201 |
| 2008/0169657 | A1 * | 7/2008 | Horton | E05B 83/30 200/557 |
| 2013/0099511 | A1 * | 4/2013 | Dow | E05B 81/15 292/226 |
| 2015/0145263 | A1 * | 5/2015 | Farris | E05B 85/26 292/195 |
| 2016/0340939 | A1 * | 11/2016 | Scholz | E05B 79/08 |

* cited by examiner

RATCHET UNIT FOR MOTOR VEHICLE FLAPS OR MOTOR VEHICLE DOORS

FIELD OF DISCLOSURE

The invention relates to a ratchet unit for motor vehicle flaps or motor vehicle doors, in particular motor vehicle rear doors and preferably motor vehicle rear sliding doors, with an electromotive drive and a ratchet lever which can be acted upon by the drive, the ratchet lever being set up to lock and to open the flap.

BACKGROUND OF DISCLOSURE

In the prior art according to DE 10 2015 014 843 A1, a motor vehicle is described which has a flap that can be adjusted relative to the body via two joint mechanisms. The flap can be pivoted out of a closed position into an open position, guided by the joint mechanisms. Moreover, the flap can be raised from the closed position into a position offering protection for pedestrians. In fact, the flap is mostly a front flap or hood.

Furthermore, the flap or front hood in question is also equipped with a locking mechanism on the front. This has a locking element on the flap side and an actuating element which can be actuated manually. This allows the flap to be pivoted up manually. In addition to the aforementioned front locking mechanism, a motor vehicle latch assigned to the flap is usually also implemented.

Consequently, the ratchet unit represents an additional safeguard in addition to the motor vehicle lock, but in general can also replace it. Among other things, this is the procedure for the generic prior art according to DE 20 2006 017 864 U1. This involves a container or a module box which is arranged in the interior of the motor vehicle and has a separate locking means. For this purpose, the latch for locking the container is equipped with an electric motor that is coupled to a locking bolt by gears. The locking bolt can be brought into three defined positions by the electric motor. One position corresponds to the release position of the container, and the second position corresponds to the locking position for the container in a socket arrangement. The third locking position provides locking of a lid of the container.

In this way, the container can be well protected against theft or removal. As a result, the container can serve as a storage place for valuable luggage and thus is secured against theft. In the prior art, the container is typically set up to hold a ski bag.

The prior art has basically proved successful, but requires a specific control of the electromotive drive in order to be able to realize and implement the open position of the ratchet lever or the known locking bolt as well as the closed position. In practice, this is often perceived to be disadvantageous, especially with regard to the motor-powered adoption of the closed position. If, for example, a tailgate or rear door of a motor vehicle is or is to be equipped with such a ratchet unit, the operators assume that the ratchet unit has also adopted its closed position by closing the tailgate or rear door in question and that no additional operations are required. Until now there have been no convincing solutions to this in practice. This is the starting point for the invention.

SUMMARY OF DISCLOSURE

The invention is based on the technical problem of developing such a ratchet unit for motor vehicle flaps or motor vehicle doors in such a way that particularly simple and intuitive operation is made available.

To solve this technical problem, a generic ratchet unit for motor vehicle flaps or motor vehicle doors is characterized according to the invention in that the ratchet lever continuously adopts its closed position and is only moved into its open position for opening the motor vehicle flap with the aid of the drive, wherein during closing of the motor vehicle flap the ratchet lever is deflected resiliently in its closed position.

Thus, in the context of the invention, the ratchet lever initially and continuously adopts its closed position. As a result, the motor vehicle flap or motor vehicle door in question is secured throughout with the aid of the ratchet unit, i.e. it maintains its closed position. That is, an unintentional and spring-loaded pivoting up of the motor vehicle flap or motor vehicle door in question is explicitly not possible. The procedure here is usually such that the ratchet lever is biased in the direction of its closed position with the aid of a spring.

The ratchet lever is actually released only when the motor vehicle flap or motor vehicle door in question is to be opened, and also only when the electromotive drive is acted upon for this purpose and the ratchet lever is moved into its open position by means of said drive, against the force of the spring which biases the locking lever in the direction of its closed position. As a result, reliable latching or locking of the motor vehicle flap or motor vehicle door with respect to an associated motor vehicle body is provided and guaranteed. As a consequence of this, the ratchet unit can generally and solely ensure the closure of the relevant motor vehicle flap or motor vehicle door, i.e. without the additional provision of a motor vehicle latch or motor vehicle door latch.

Since such a ratchet unit has a simple design, a particularly simple and inexpensive latching and release of the relevant motor vehicle flap or motor vehicle door can be provided and implemented in this way. In addition, the operation is simple and intuitive, because to open the relevant motor vehicle flap or motor vehicle door it is only necessary to activate the electromotive drive.

This in turn ensures that the ratchet lever is moved from its continuously adopted closed position into the open position. During this process, the electromotive drive overcomes the force of the spring acting on the ratchet lever in the direction of its closed position. As a result of this, the relevant motor vehicle flap or motor vehicle door can now be opened manually or also by a motor or by spring force. For example, it is conceivable that, with the aid of a command or a (single) switch actuation by the operator, the electromotive drive for acting on the ratchet lever is first moved into its open position and then an additionally provided electromotive drive for the motor vehicle flap or motor vehicle door is acted upon and ensures the opening of the corresponding flap or door.

Of course, this process can also be represented by two different actuations. In any case, opening the relevant motor vehicle flap or motor vehicle door is linked to a special routine of the operator which can be initiated comfortably and intuitively from the interior. In principle, however, the electromotive drive and, with it, the ratchet lever can also be controlled using a remote control.

In addition to this opening process, the closing process of the relevant motor vehicle flap or motor vehicle door is also intuitive and easy. This is because in this case the ratchet lever, which is continuously in its closed position, is overrun and is deflected resiliently when the motor vehicle flap or motor vehicle door is closed. The spring which biases the ratchet lever in the direction of its closed position regularly ensures this resilient deflection. The essential advantages can be seen here.

According to an advantageous embodiment, the ratchet lever is connected to the drive via a freewheel. When the flap is closed, the previously described resilient deflection of the ratchet lever in its closed position can be performed and implemented particularly elegantly and easily by means of the freewheel. For this purpose, the freewheel consists essentially of an actuation rod connected to the drive and a lever-side receptacle with clearance for the actuation rod.

That is to say, a clearance is observed between the lever-side receptacle for the actuating rod and the actuating rod itself and can accommodate the actuating rod with respect to the lever-side receptacle. As a result, the freewheel between the ratchet lever and the drive is made available and the ratchet lever in its closed position can be deflected resiliently against the force of the spring, in particular during closing of the motor vehicle flap.

In detail, the lever-side receptacle with clearance is designed as a bearing arrangement through which the actuating rod extends. In this case, two spaced bearings through which the actuating rod extends are usually implemented. As a consequence of this, the actuating rod can perform a linear movement with respect to the bearing arrangement in question, which movement corresponds to the clearance and the freewheel resulting therefrom. In the context of another variant, the lever-side receptacle with clearance can also be designed as a slot guide in the ratchet lever for the actuating rod. In this case, by means of an actuating pin at the end the actuating rod usually engages in said slot guide in the ratchet lever. The actuating pin can be moved back and forth in the slot guide, thereby providing the required clearance and the associated freewheel between the ratchet lever and the drive.

The ratchet lever is usually designed as a two-arm lever which is rotatably mounted at the end and has a bearing arm and an actuating arm. The ratchet lever is rotatably mounted, specifically at one end, with the aid of the bearing arm. For this purpose, a stationary bearing journal or bearing bolt typically extends through an opening at the end in the bearing arm of the ratchet lever.

The ratchet lever interacts with the motor vehicle flap or motor vehicle door by means of the actuating arm. For this purpose, the actuating arm is usually connected to the bearing arm at an angle. In addition, the actuating arm usually has a leading edge that protrudes into the travel path of the motor vehicle flap or motor vehicle door. The leading edge of the actuating arm in question usually interacts with a pin or an extension on the motor vehicle flap or motor vehicle door.

In addition, the actuating arm is usually also equipped with an abutment edge which likewise protrudes into the travel path of the motor vehicle flap. The abutment edge also protrudes into the travel path of the motor vehicle flap. The design is predominantly such that, during closing of the relevant motor vehicle flap or motor vehicle door, the previously mentioned pin or extension encounters the leading edge on the actuating arm on the motor vehicle flap or motor vehicle door, and in this way the actuating arm and thus the ratchet lever is pivoted. Since the ratchet lever is in its closed position and can move resiliently when the flap is closed, the ratchet lever is driven over, as it were, and pivots back again into its closed position after passing the pin or extension on the relevant motor vehicle flap or motor vehicle door. This is ensured by the spring biasing the ratchet lever in the direction of its closed position.

In the closed position of the ratchet lever and with the motor vehicle flap or motor vehicle door closed, the abutment edge on the actuating arm now ensures that the motor vehicle flap or motor vehicle door in question cannot be opened from the closed position. In other words, there is a blocking interaction between the abutment edge of the ratchet lever and the relevant motor vehicle flap or motor vehicle door or the pin or extension attached to it. In order to override this blocking, the ratchet lever must be moved into its open position. In this case, the electromotive drive ensures that the ratchet lever, which is acted upon in its open position, is pivoted out of the travel path with its actuating arm. This takes place against the force of the spring. As a result of this, the relevant motor vehicle flap or motor vehicle door can be opened because the associated pin or extension can now pass the pivoted or retracted actuating arm without collision. Finally, the relevant motor vehicle flap or motor vehicle door can be opened manually or by an electric motor or also in another way, for example by spring force.

As a result, a ratchet unit for motor vehicle flaps or motor vehicle doors is provided which can be operated intuitively and works correctly. In addition, a particularly simple and inexpensive structure is implemented and observed. For this it is only necessary that the electromotive drive works on the ratchet lever. For this purpose, the electromotive drive is typically a linear drive, which then works on the actuating rod, which is also linearly movable. For this purpose, the actuating rod may be connected to a control member at the end of the electromotive drive. However, there is also the possibility that the control member and the actuating rod define a structural unit. In this case, the procedure will typically be such that the structural unit consisting of the control member and the actuating rod is equipped with the actuating pin at the end, which in turn engages in the slot guide in the ratchet lever.

In either case, linear movements of the electromotive drive are usually transmitted to the actuating rod or the structural unit comprising the control member and the actuating rod. These linear control movements ensure that the ratchet lever performs the desired pivoting movement about its axis of rotation defined by the bearing journal or bearing bolt, in particular to adopt its open position. In contrast, the ratchet lever adopts its closed position throughout with the aid of the spring biasing the ratchet lever in the direction of its closed position. The particularly compact and cost-effective structure is further enhanced by the fact that ultimately the ratchet lever and the drive are usually arranged on a common mounting flange, and are usually connected to this mounting flange. The essential advantages can be seen here.

BRIEF DESCRIPTION OF DRAWINGS

The invention is explained in greater detail below with reference to drawings, which show only one embodiment. In the drawings.

DETAILED DESCRIPTION

Figure 1:
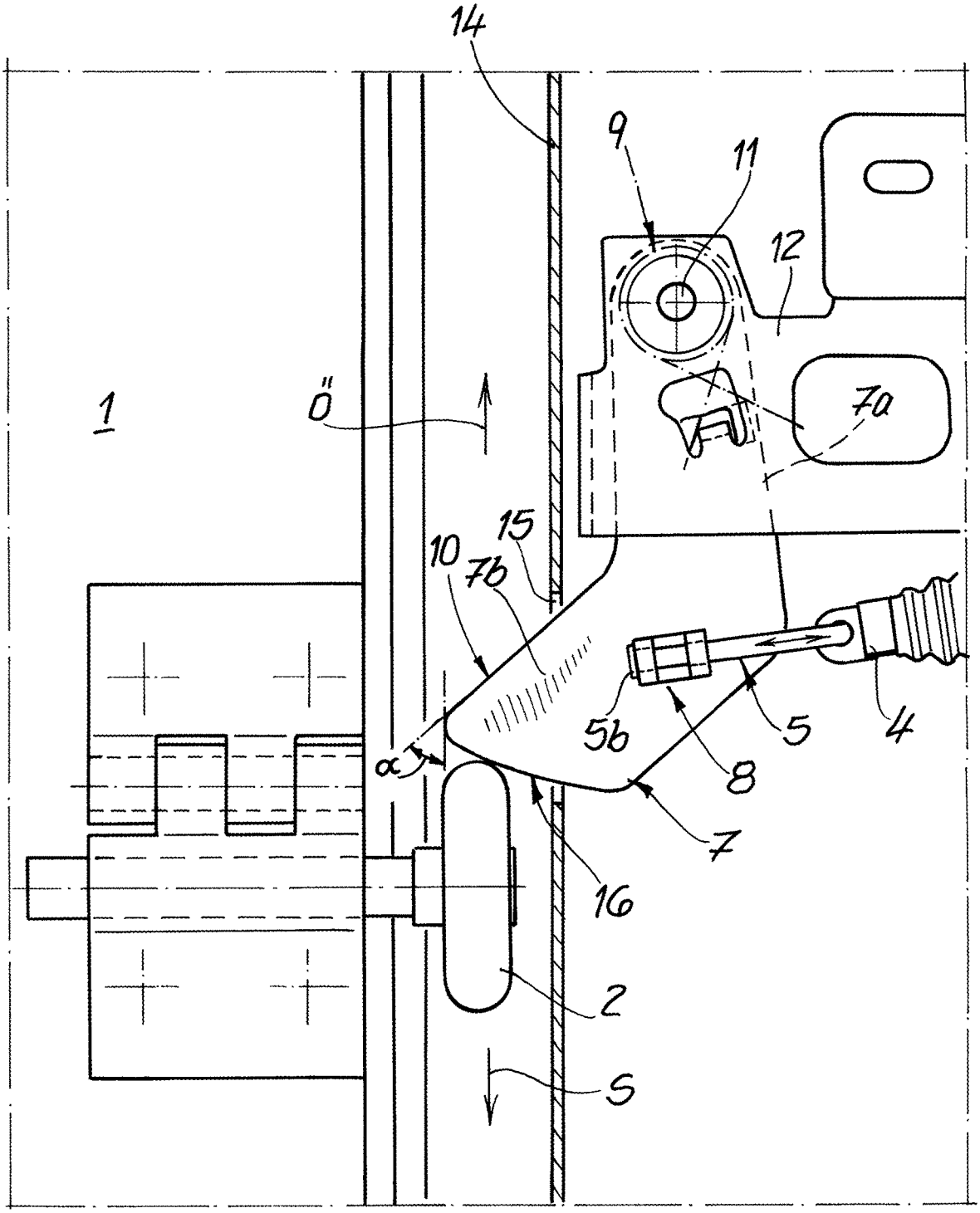
FIG. 1 shows the ratchet unit according to the invention for motor vehicle flaps or motor vehicle doors in the closed position of the ratchet lever.

In the figures, a ratchet unit for motor vehicle flaps 1 or motor vehicle doors is shown. The motor vehicle flap 1 shown in FIG. 1 is a motor vehicle rear sliding door 1 or a motor vehicle rear door on a panel van. The motor vehicle rear sliding door 1 is moved upwards in the direction of an opening arrow Ö in FIG. 1. In contrast, a closing movement of the motor vehicle rear door or motor vehicle rear sliding door 1 corresponds to a movement downward along the arrow S.

In the example, the illustrated motor vehicle rear door or motor vehicle rear sliding door 1 has a connected pin or extension 2 which interacts with an associated ratchet unit. As evidenced by the overview in FIGS. 2 and 3, the ratchet unit has an electromotive drive 3, 4. According to the embodiment, the electromotive drive 3, 4 works as a linear control drive and in this way ensures that a control member 4 at the end can perform linear movements, as indicated in the figures by way of example by a double arrow. For this purpose, the electromotive drive 3, 4 may be constructed in detail and internally as described in DE 10 2017 113 528 A1 of the applicant. It can be seen that the electromotive drive 3, 4 is encapsulated overall and the control member 4, which can be moved linearly back and forth, is connected to a housing of the drive 3, 4 via a bellows arrangement.

An actuating rod 5 is acted upon with the aid of the electromotive drive 3, 4, and consequently also performs linear movements. In the variant according to FIG. 3, the actuating rod 5 is suspended in a front eyelet on the control member 4 as part of the electromotive drive 3, 4. In the variant according to FIG. 4, the control member 4 and the actuating rod 5 define a structural unit 4, 5, which engages there with an actuating pin 5*a* at the end in a slot guide 6 of a ratchet lever 7 that can be acted upon by the electric motor drive 3, 4.

Figure 2:
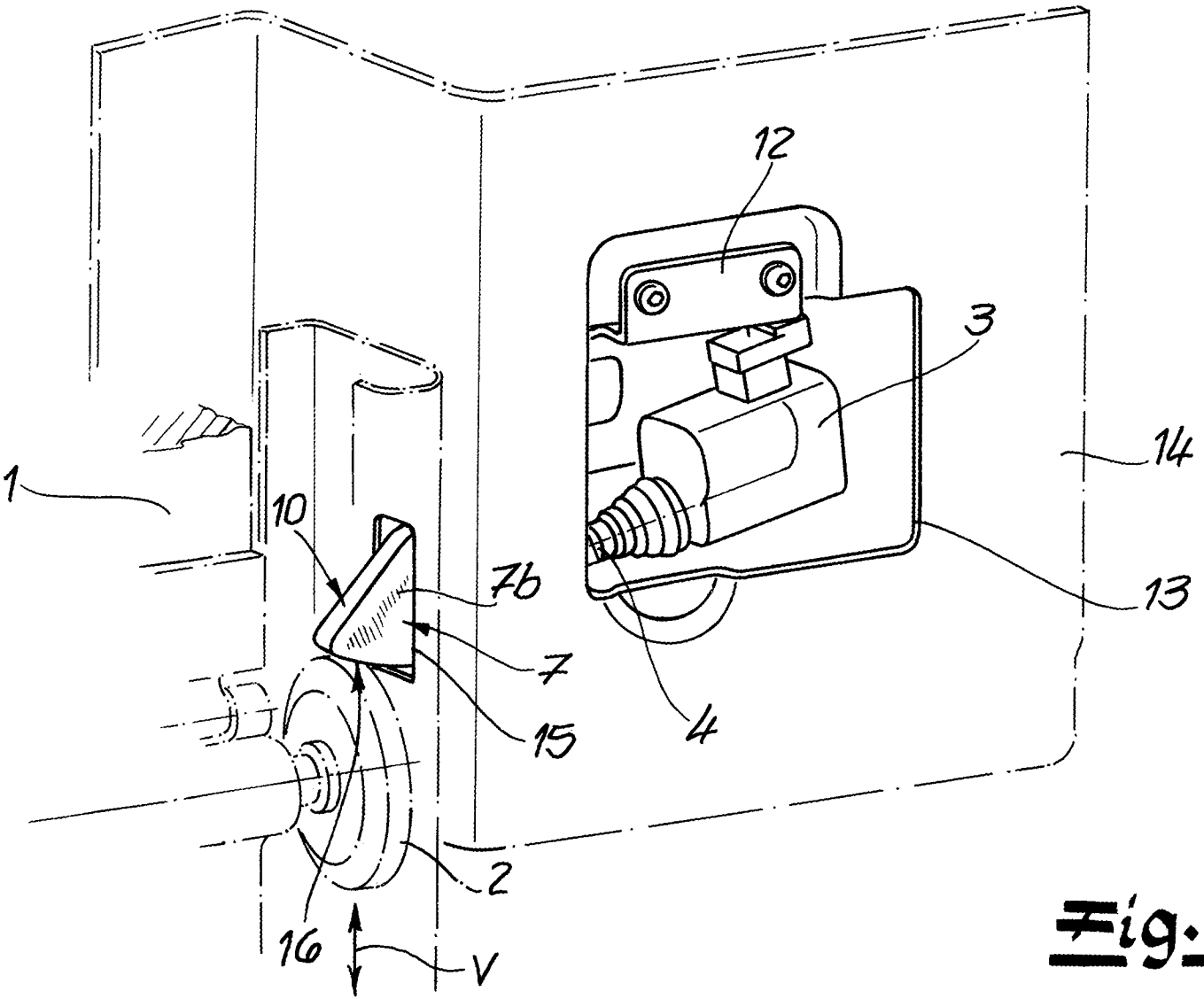
FIG. 2 is a perspective view of the object according to FIG. 1.
Figure 3:
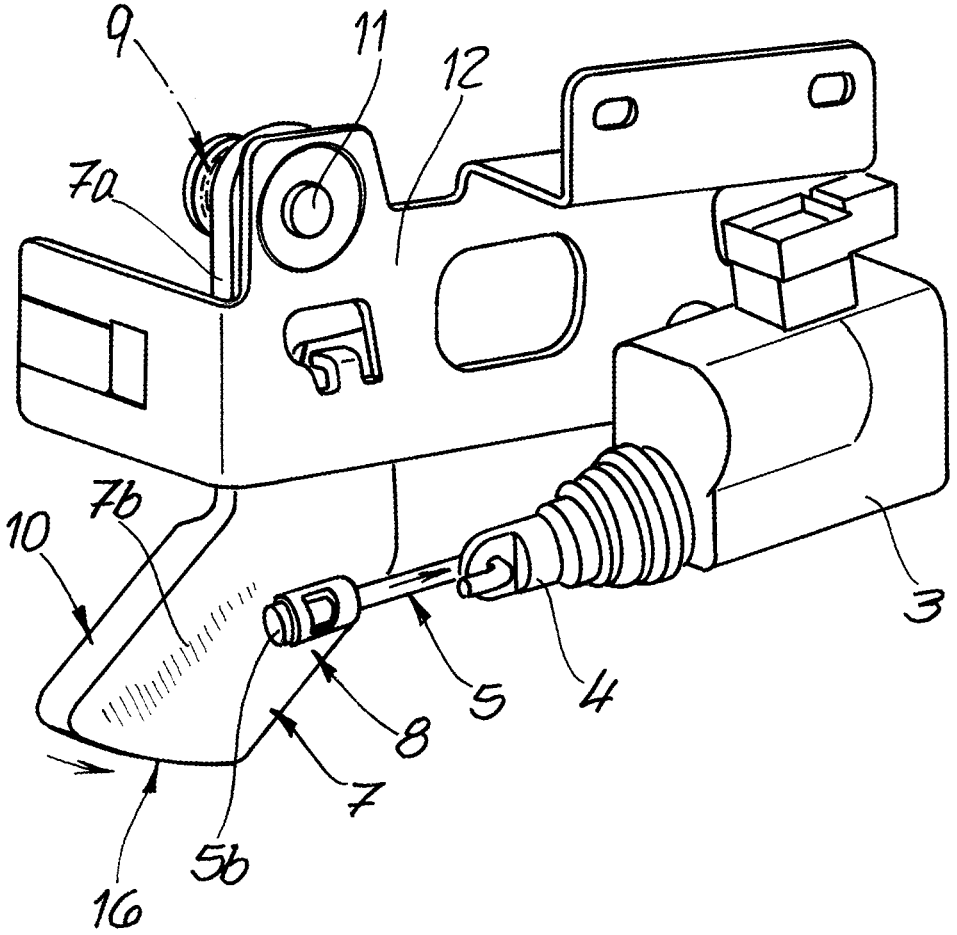
FIG. 3 shows the electromotive drive in an overview in a first embodiment and FIG. 4 shows the electromotive drive in a further second variant.

In contrast, the design in the variant according to FIG. 3 is such that the actuating rod 5 extends through a lever-side bearing arrangement 8 on the ratchet lever 7. In both cases, the ratchet lever 7 is set up and designed for locking and for opening of the motor vehicle flap 1 or the motor vehicle rear sliding door 1 in the example. For this purpose, the ratchet lever 7 continuously adopts its closed position as shown in FIGS. 1 and 2, 3. In order to move the ratchet lever 7 into its open position also shown by dash-dot lines in FIG. 4, the ratchet lever 7 is moved with the aid of the electromotive drive 3, 4 into said opening position shown by dash-dot lines in FIG. 4. Since the ratchet lever 7 continuously adopts its closed position, it is overrun in said closed position during closing of the motor vehicle flap 1. Corresponding to this, when the motor vehicle flap 1 is closed, the ratchet lever 7 in its closed position is deflected resiliently in the direction of the arrow S, as will be explained in more detail below.

In fact, the ratchet lever 7 is connected via a freewheel 5; 6, 8 to the electromotive drive 3, 4. For this purpose, the freewheel 5; 6, 8 consists essentially of the actuating rod 5 connected to the electromotive drive 3, 4, on the one hand, and a lever-side receptacle 6, 8 with clearance for the actuating rod 5, on the other hand.

In the context of the variant according to FIG. 3, the lever-side receptacle 6, 8 with clearance for the actuating rod 5 is designed as a bearing arrangement 8 through which the actuating rod 5 extends. In the variant according to FIG. 4, on the other hand, the lever-side receptacle 6, 8 with clearance is the slot guide 6 implemented there in the ratchet lever 7 for the actuating rod 5.

When looking at FIG. 3, it can be seen that the bearing arrangement 8 through which the actuating rod 5 passes with a clearance has two spaced-apart bearing eyes, through both of which the actuating rod 5 can move linearly back and forth. For this purpose, the actuating rod 5 has an end abutment 5*b* which, according to the embodiment in FIG. 3, moves into its open position against the left one of the two bearing eyes to act on the ratchet lever 7. As a result, the ratchet lever 7 is pivoted about an axis of rotation defined by a bearing pin 11 for the ratchet lever 7 in order to adopt its open position, specifically in the counterclockwise direction, as indicated by a corresponding arrow in FIG. 3. The ratchet lever 7 also performs a comparable pivoting movement in the counterclockwise direction about the axis of rotation defined by the bearing pin 11 when it is in the closed position and the pin or extension 2 on the motor vehicle flap 1 passes over it. In fact, during this process, the ratchet lever 7 in its closed position is deflected resiliently. This is possible because, during this process, the relevant pin or extension 2 moves against a leading edge 10 of the ratchet lever 7. The counterclockwise movement of the ratchet lever 7 initiated by this is permitted because during this process the bearing arrangement 8, which is designed as a lever-side receptacle and through which the actuating rod 5 passes, permits such a movement and is moved to the right on the actuating rod 5 in the embodiment according to FIG. 3.

Figure 4:
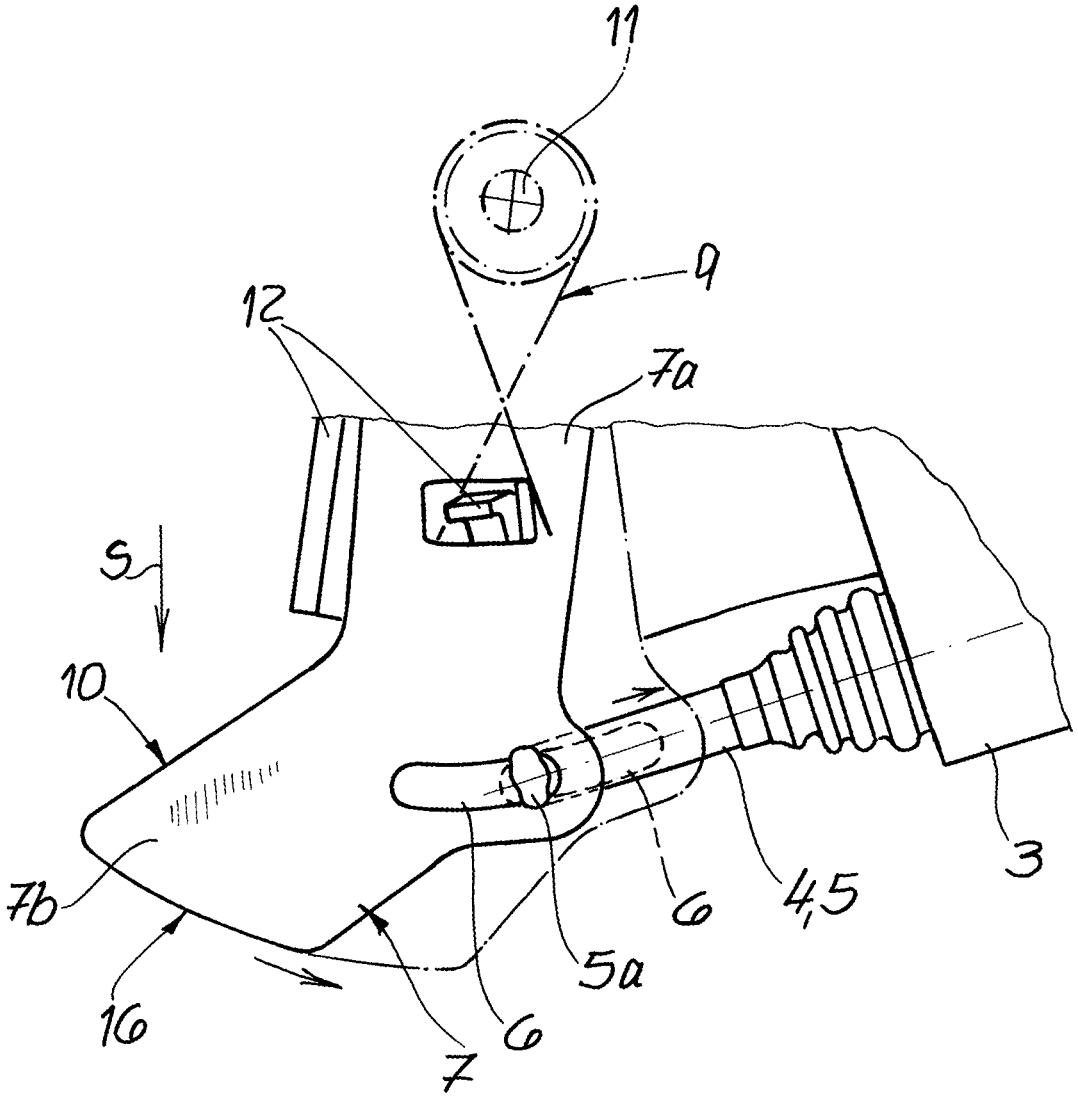

The procedure is similar in the variant according to FIG. 4, with the only difference that, during closing of the motor vehicle flap 1, the ratchet lever 7 in the closed position moves with its slot guide 6 along the actuating pin 5*a* at the end of the actuating rod 5 or the structural unit 4, 5. In any case, in its closed position the ratchet lever 7 is deflected resiliently during closing of the motor vehicle flap 1. This is ensured by a spring 9 which biases the ratchet lever 7 in the direction of its closed position. It can be seen that the spring 9 is designed as a leg spring. For this purpose, the spring 9 has a coiled section which encloses the bearing pin 11 for the ratchet lever 7. One leg of the leg spring is connected to the ratchet lever 7 and acts on it in the direction of its closed position. The other leg of the leg spring, on the other hand, rests in a stationary manner on a mounting flange 12.

The ratchet lever 7 is designed as a two-arm lever rotatably mounted at the end with the aid of the bearing pin 11. In fact, the ratchet lever 7 is composed of a bearing arm 7*a*, on the one hand, and an actuating arm 7*b*, on the other hand. The actuating arm 7*b* is connected to the bearing arm 7*a* at an angle. According to the embodiment, the two arms 7*a*, 7*b* enclose an angle of approximately 130° to 140°. As a result of this, the abovementioned leading edge 10 has an angle $\alpha$ of approximately 40° to 50° with respect to the closing direction S of the motor vehicle flap 1, as shown in FIG. 1. Of course, this only applies as an example.

The already mentioned leading edge 10 is found on the actuating arm 7*b* of the ratchet lever 7. In addition, the actuating arm 7*b* in question is also equipped with a stop edge 16. According to the embodiment, the stop edge 16 interacts with the pin or extension 2 and thus the motor vehicle flap 1, specifically in its closed state, as can be seen from FIG. 1. Any opening movement in the direction Ö of the relevant motor vehicle flap 1 results in a force vector being predominantly oriented in the direction of the axis of rotation or the bearing pin 11 of the ratchet lever 7, and consequently this opening movement in the direction Ö works neutrally on the ratchet lever 7 and no torque is generated at this point.

Finally, it can be seen that the ratchet lever 7 and the electromotive drive 3, 4 taken together are arranged on the aforementioned common mounting flange 12 or are connected to this mounting flange 12. As a result, the entire arrangement can be attached and placed in a compact and simple manner in an opening 13 shown in FIG. 2 inside a body 14. At the same time, the ratchet lever 7 can be brought into a travel path V of the motor vehicle flap 1 without any problems and, as described, the ratchet lever 7 in question adopts its closed position continuously and, in this closed position, is deflected resiliently when the motor vehicle flap 1 is closed. To open the motor vehicle flap 1 the ratchet lever 7 is, as it were, withdrawn from a further opening 15 in the body 14 with the aid of the electromotive drive 3, 4.

LIST OF REFERENCE SIGNS

1 motor vehicle flap, motor vehicle rear sliding door
2 pin, extension
3, 4 electromotive drive
4 control member
4, 5 structural unit
5 actuating rod
5; 6, 8 freewheel
5*a* actuating pin
5*b* abutment
6 slot guide
6, 8 receptacle
7 ratchet lever
7*a* bearing arm
7*b* actuating arm
8 bearing arrangement
9 feather
10 leading edge
11 bearing pin
12 mounting flange
13 opening
14 body
15 opening
16 abutment edge
Ö opening arrow, direction
S arrow, closing direction
V travel path

The invention claimed is:

1. A ratchet unit for a motor vehicle flap or door, the ratchet unit comprising:

an electromotive drive; and a ratchet lever that is acted upon by the electromotive drive, the ratchet lever being configured for locking and for opening the motor vehicle flap or door, wherein the ratchet lever is arranged on a mounting flange, wherein a body of the ratchet lever rotates about an axis of rotation, wherein the ratchet lever is biased about the axis of rotation in a closed position by a leg spring and is only moved about the axis of rotation into an open position for opening the motor vehicle flap or door with the aid of the electromotive drive, wherein during closing of the motor vehicle flap or door, the ratchet lever is deflected resiliently in the closed position, wherein a coiled portion the leg spring is arranged at the axis of rotation, wherein a first leg of the leg spring engages a portion of the ratchet lever and a second leg of the leg spring engages a portion of the mounting flange extending through an opening in the ratchet lever.

2. The ratchet unit according to claim 1 further comprising a freewheel, wherein the ratchet lever is connected to the electromotive drive via the freewheel.

3. The ratchet unit according to claim 2, wherein the freewheel includes an actuating rod connected to the electromotive drive and a lever-side receptacle with a clearance for the actuating rod.

4. The ratchet unit according to claim 3, wherein the lever-side receptacle with the clearance is formed as a bearing arrangement through which the actuating rod extends.

5. The ratchet unit according to claim 3, wherein the lever-side receptacle with the clearance is formed as a slot guide in the ratchet lever for the actuating rod.

6. The ratchet unit according to claim 3, wherein the actuating rod is linearly moved by the electromotive drive.

7. The ratchet unit according to claim 6, wherein the actuating rod includes an actuating pin that engages with an end of a slot guide formed in the ratchet lever.

8. The ratchet unit according to claim 1, wherein the ratchet lever is a two-arm lever which is rotatably mounted and has a bearing arm and an actuating arm.

9. The ratchet unit according to claim 8, wherein the actuating arm is connected to the bearing arm at an angle.

10. The ratchet unit according to claim 8, wherein the actuating arm has a leading edge and a stop edge and protrudes into a travel path of the motor vehicle flap or door.

11. The ratchet unit according to claim 10, wherein the abutment edge is configured to engage an extension of the motor vehicle flap or door.

12. The ratchet unit according to claim 8, wherein the ratchet lever is rotatably mounted at an end of the ratchet lever on the bearing arm.

13. The ratchet unit according to claim 1, wherein the electromotive drive is also arranged on the mounting flange.

14. The ratchet unit according to claim 13, wherein the mounting flange is fixed in an opening inside a body of a motor vehicle.

15. The ratchet unit according to claim 14, wherein the ratchet lever is received in a second opening formed in the body.

16. The ratchet unit according to claim 1, wherein the electromotive drive includes a control member that is connected to a housing of the electromotive drive by a bellows arrangement.

17. The ratchet unit according to claim 1, wherein the electromotive drive is a linear control drive.

* * * * *